United States Patent [19]

Durand et al.

[11] Patent Number: 4,831,944

[45] Date of Patent: May 23, 1989

[54] PROCESS AND DEVICE FOR DESTROYING SOLID WASTE BY PYROLYSIS

[75] Inventors: Jean-Pierre Durand, La Seyne-sur-Mer; Maxime Labrot, Bordeaux, France; Joel Truc, Toulon; Yves Valy, Saint-Medard-En-Jalles, all of

[73] Assignees: Aerospatiale Societe Nationale Industrielle; Constructions Navales et Industrielles de la Mediterranee, both of Paris, France

[21] Appl. No.: 147,205

[22] Filed: Jan. 22, 1988

[30] Foreign Application Priority Data

Jan. 22, 1987 [FR] France ..... 87 00726

[51] Int. Cl.[4] ..... F23G 5/12

[52] U.S. Cl. ..... 110/346; 48/209; 110/229

[58] Field of Search ..... 110/256, 229, 346; 48/76, 111, 209

[56] References Cited

U.S. PATENT DOCUMENTS

| | | | |
|---|---|---|---|
| 3,841,239 | 10/1974 | Durand et al. . | |
| 3,894,573 | 7/1975 | Paton et al. | 164/52 |
| 4,508,040 | 4/1985 | Santen et al. | 110/347 |
| 4,546,483 | 10/1985 | Lugscheider et al. | 373/24 |
| 4,606,038 | 8/1986 | Lugscheider et al. | 373/24 |
| 4,718,362 | 1/1988 | Santen et al. | 110/229 X |

*Primary Examiner*—Edward G. Favors

*Attorney, Agent, or Firm*—Fisher, Christen & Sabol

[57] ABSTRACT

This invention relates to a process and device for destroying solid waste by pyrolysis, in which a column of such waste is upwardly traversed at least partially by a stream of hot gas blown in at the base of said column, wherein said stream of hot gas is generated by at least one plasma jet. The invention results in the destruction of non-burned residues and in the improved flow of the molten residues.

11 Claims, 2 Drawing Sheets

PROCESS AND DEVICE FOR DESTROYING SOLID WASTE BY PYROLYSIS

The present invention relates to a process and a device for the destruction and treatment of solid waste, particularly waste of hospital and/or industrial origin.

It is known that solid waste, such as waste from hospitals for example, is generally destroyed in roasting furnaces in which the temperature of combustion is maintained at a high value by fossil combustible burners. The ash and clinker are evacuated in solid form, as the fossil combustibles do not make it possible to attain sufficiently high temperatures to fluidify them, and contain many non-burned residues which present a danger for the environment and foul the evacuation conduits. Moreover, such a combustion requires an excess of air.

Moreover, it is known that, in order to avoid such drawbacks, the solid waste may also be destroyed by pyrolysis, employing a draft of hot air making it possible to obtain high temperatures and to ensure an air-deficient combustion. To that end, a pyrolysis furnace is used, which is generally in the form of a vertical cylinder (or several truncated cones). The waste is charged in the upper part and is heated and pyrolyzed, as it descends in the furnace, by the hot gases issuing from pyrolysis which circulate in counterflow, i.e. upwardly. The draught of hot air is blown in the low part of the furnace. It brings part of the heat energy necessary for operation and the oxygen ensuring combustion of part of the waste thus producing the complementary heat energy. With such a pyrolysis furnace, the ash and clinker are evacuated at high temperature in pasty form, but the metals are not entirely melted and the flow of this very viscous matter is difficult and uncertain. Moreover, known pyrolysis furnaces do not make it possible satisfactorily to monitor the temperature of the molten residues.

It is an object of the present invention to overcome the drawbacks of known pyrolysis furnaces. It solves the problem of the non-burned substances contained in the residues coming from the destruction of the solid waste and it improves the flow of these molten residues.

To that end, according to the invention, the process for destroying solid waste by pyrolysis, whereby a column of such waste is traversed at least partially, upwardly, by a stream of hot gas blown in at the base of said column, is noteworthy in that said stream of hot gas is created by at least one jet of plasma, and preferably by a plurality of jets of plasma distributed on the periphery of said column of waste, in the vicinity of the base thereof.

In this way, the hot gas blown in at the base of the pyrolysis furnace and traversing the column of waste is no longer air, but a gas produced by one or more plasma generators (torches), which makes it possible to monitor the temperature of the molten residues.

The plasma jet is preferably directed to the base of the waste column, at the spot where it penetrates in the bath of molten slag. It thus completes the melting of the waste which has undergone pyrolysis and it increases the temperature of the slag, thus giving it the fluidity required for suitable flow.

To that end, it is advantageous if the direction of each plasma jet be inclined downwardly, with respect to the horizontal, in the direction of the base of said column.

In order to make it possible to select the location of the point of impact of the inner cone of the plasma torches on a section of said column as a function for example of the nature of the waste, the direction of each plasma jet with respect to the horizontal is provided to be adjustable.

Furthermore, in order to allow greater efficiency and greater freedom of choice of the point of impact of the inner cones of the plasma torches on the base of the waste column, the direction of each jet of plasma is provided to be inclined with respect to the direction of the corresponding radius of the waste column and this direction is provided to be adjustable.

Consequently, thanks to the invention, the following advantages may be obtained:

(a) by adjusting the power and/or the enthalpy of the plasma and/or by selecting the nature of the plasmagene gas, the supply of oxygen to the furnace, therefore the quantity of oxidized matter and consequently the quantity of heat released, are adjusted;

(b) by adjusting the power of the or each plasma-generating torch, the heat power introduced in the furnace in complement of the energy released by pyrolysis is adjusted;

(c) by adjusting the angle of inclination of the or each torch with respect to the horizontal, the inner cone may be directed preferentially onto the waste or onto the slag and the distribution of the heat brought to the waste and to the slag may thus be varied;

(d) by adjusting the orientation of the torch with respect to the axis of the furnace, movements of convection of the slag are created which promote the homogenization of its temperature and of its fluidity.

Any appropriate plasmagene gas may be used.

To carry out the process according to the invention, a device is provided for destroying solid waste by pyrolysis, comprising a vertical wall in which is guided a column of such waste, means for blowing a jet of hot gas disposed in the lower part of said wall and means for evacuating the hot gases disposed in the top part of said wall, this device being noteworthy in that said hot gas jet blowing means are constituted by at least one plasma generator.

Said gas jet blowing means are preferably constituted by a plurality of plasma generators distributed over the periphery of said lower part of said wall.

Said plasma generators are advantageously adjustable in orientation about a horizontal axis and/or about a vertical axis.

Although they may be adjusted collectively in orientation, said plasma generators are preferably adjustable individually.

When, in known manner, said device comprises an orifice for pouring the molten slag provided in the bottom of said device, at least one of said plasma generators is disposed at least substantially plumb with said pouring orifice.

It will be noted that the plasma jet participates on the one hand in the vertical stability of the charge and, on the other hand, in the clearing of the pouring orifice (thus avoiding the passage of non-pyrolyzed matter).

It is seen that, owing to the invention, all sorts of solid waste may be destroyed, even that mixed with pasty waste.

The invention will be more readily understood on reading the following description with reference to the accompanying drawings, in which.

Figure 3:
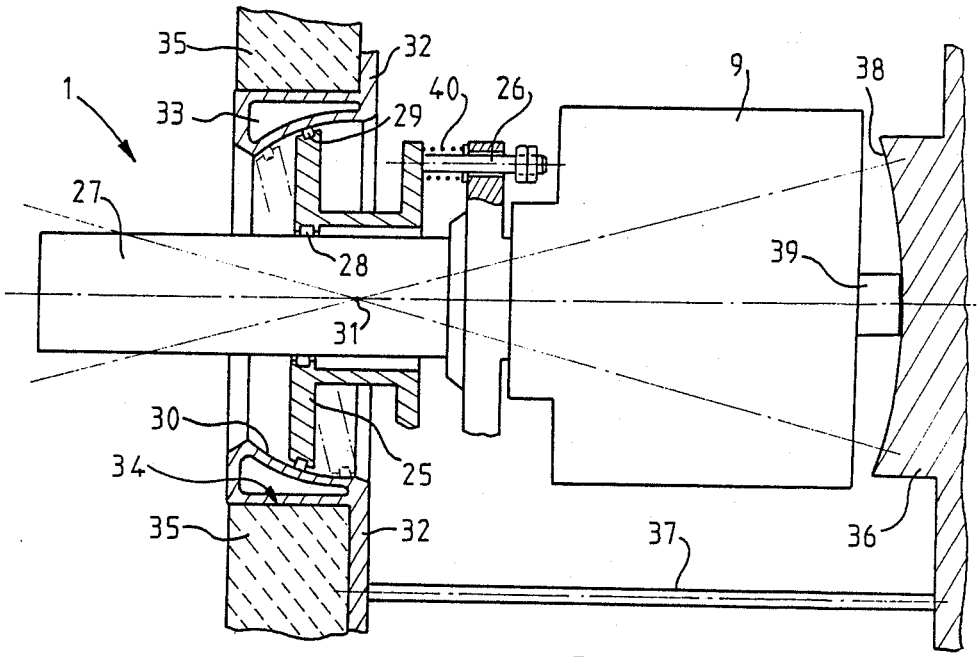

FIG. 3 schematically illustrates in section a detail of the assembly of a plasma torch on a pyrolysis furnace according to the present invention.

Figure 1:
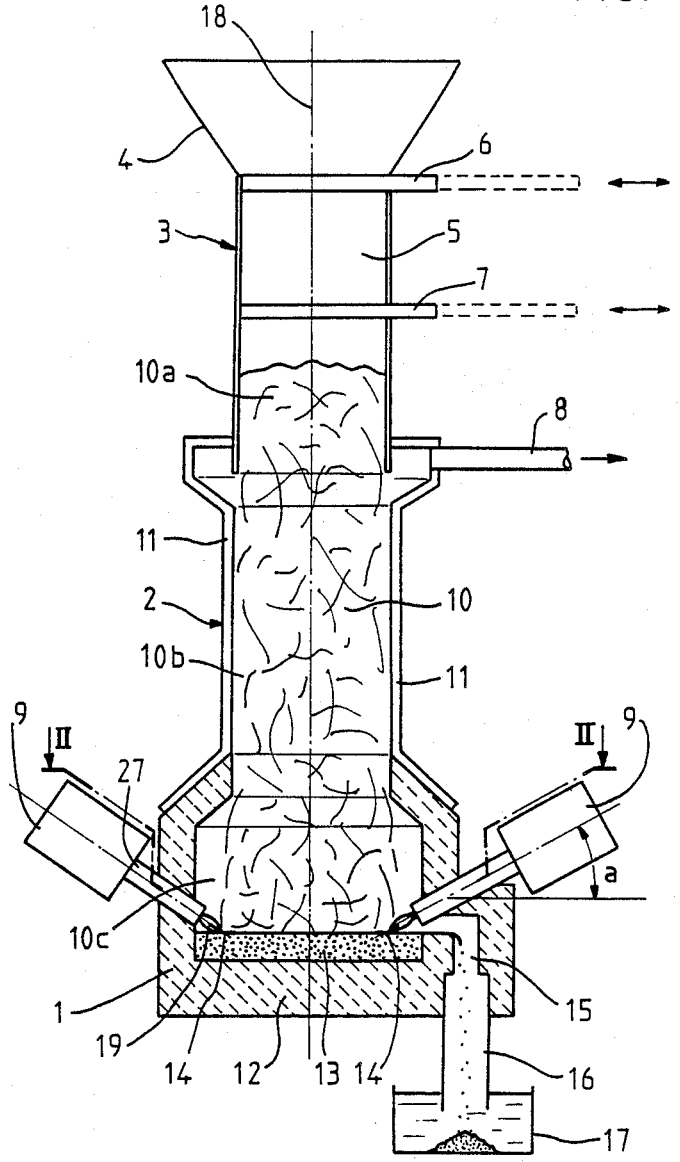
FIG. 1 is a schematic vertical section through a pyrolysis furnace according to the present invention.
Figure 2:
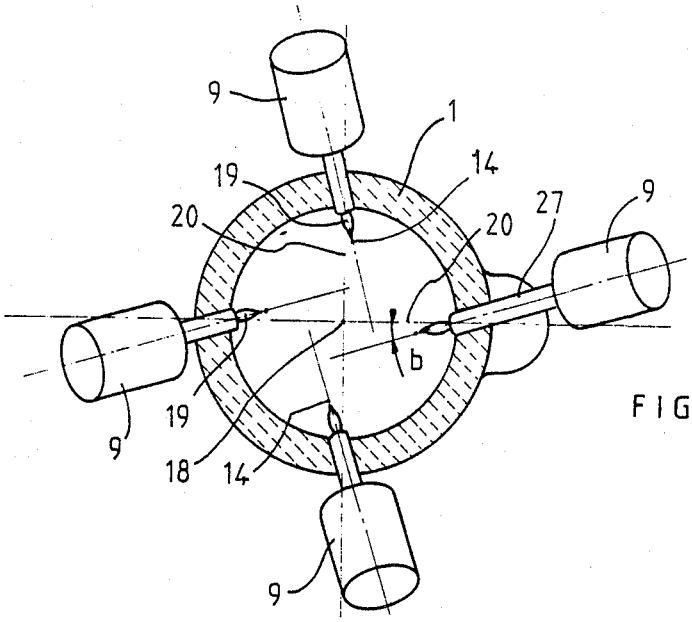
FIG. 2 is a schematic horizontal section corresponding to line II—II of FIG. 1.

Referring now to the drawings, the pyrolysis furnace according to the invention and shown in FIGS. 1 and 2, comprises a fireclay crucible 1, surmounted by a vertical envelope in two parts 2 and 3, the upper part 3 of said envelope itself being surmounted by a hopper 4.

Beneath the hopper 4, in the upper part 3 of the envelope, there is provided a chamber 5 defined by an upper register 6 and a lower register 7.

A conduit 8 for evacuating the gases is provided where the two parts of envelope 2 and 3 join.

Plasma torches 9 are disposed on the periphery of the crucible 1 and directed towards the interior thereof.

The waste to be destroyed are charged in the furnace via the hopper 4 and passes through the chamber 5 which ensures tightness with respect to the outside.

The upper part 3 of the envelope, of which the section advantageously increases downwardly in order to avoid tamping, guides the waste column 10 in its descent by gravity.

The upper part 10*a* of the waste column contained in the upper part 3 of the envelope (beneath register 7) protects the chamber from direct contact with the gases leaving the furnace via conduit 8. Combustion of these gases in a post-combustion chamber, cooling and processing thereof are not described hereinafter, as they are not included within the scope of the present invention.

The lower part 2 of the envelope, advantageously cooled by a water jacket 11, guides the downward descent of the median part 10*b* of the waste column 10.

The section of envelope 2 also increases downwardly in order to avoid tamping. The waste contained in this zone 10*b* is progressively dried, decomposed and pyrolyzed by the hot gases coming from the lower part of the furnace.

The crucible 1 constituting the base of the furnace is entirely coated with refractory elements resisting very high temperature. The waste penetrates therein via the upper part and settle on the bottom 12 in the slag 13.

The liquid slag 13 flows through an orifice 15 traversing the bottom 12 of the crucible 1, drops into a well 16 and cools in a tank 17 filled with water.

The point of impact 14 of the jets of plasma from torches 9 on the base 10*c* of the waste column 10 may be adjusted by adjusting the angle a of the torches 9 with respect to the horizontal. If a is decreased, point 14 moves towards the still solid waste; on the other hand, if angle a increases, point 14 moves towards the slag 13.

Angles a may be different for each torch 9, thus making it possible to distribute the energy horizontally as best possible, this promoting the mixing movements. One of the torches 9 advantageously lies in the vertical plane of the pouring hole 15 so as to clear the latter.

As may be seen in FIG. 2, the torches 9 are not directed towards the axis 18 of the crucible 1, but form with the corresponding radius 20 an angle b which may be adjusted as a function of the application provided and may even be varied in order to give a movement of rotation to the molten slag and thus homogenize its temperature.

The torches 9 are supplied with electrical current and plasmogene gas in known manner (not shown). Under the effect of the stabilized electric arc in the torches, the gas is converted into plasma (for example between 3000° C. and 7000° C.) and constitutes a very high temperature inner cone 19.

By increasing the power of the plasma torches, the temperature in the crucible is increased and therefore the temperature of the slag which thus becomes more fluid.

By selecting a large angle a of the torches with respect to the horizontal, the plasma jet is preferentially directed towards the slag, and its temperature is therefore increased.

Part of the heat energy is taken to the system by the enthalpy of the plasma. The other part is contributed by the combustion of a fraction of the waste in contact with the oxygen brought by the plasma; by increasing the flowrate of gas supplying the torches, the quantity of waste oxidized by the oxygen of the plasma is increased, 5 therefore the heat energy released by combustion of the waste is increased. It is then possible to use, on the other hand, the corresponding energy of the plasma to raise the temperature of the slag, for example by increasing angle a.

In this way, by playing on the power of the torches, the flowrate of plasmagene gas and the inclination of the torches, it is possible to modify the temperature of the slag in order to obtain a liquid of suitably flowing viscosity.

Moreover, it is possible to obtain slag temperatures sufficiently high for the usual metals to be entirely melted.

Finally, at the high temperatures obtained in the slag (1500° C. for example), it is sure that all the risks of contamination, particularly pathogenic in the case of hospital waste, are eliminated. Experiments have shown that the residues collected do not contain any non-burned substances and are perfectly inert.

FIGS. 1 and 2 show an embodiment in which angles a and b are fixed once and for all at an optimum value depending on the particular structure and application of the furnace On the contrary, FIG. 3 shows the swivelling assembly of a torch 9. In the embodiment shown, said swivelling assembly is of the ball joint coupling type.

As may be seen in this FIG. 3, each torch 9 is fast with a mount 25, via fixing means 26. The nozzle 27 of said torch 9 passes through the mount 25 and an inner seal 28 ensures tightness between the latter and said nozzle. The mount 25, via a seal 29, may rotate in a spherical bearing surface 30 in order to pivot about a centre of rotation 31. The spherical bearing surface 30 is formed in a flange 32, for example hollow to form a channel 33 for circulation of a cooling fluid, which is fixed on the periphery of an orifice 34, traversing the lateral wall 35 of the crucible 1. A rear support 36, fast with the flange 32 by crosspieces 37, comprises a spherical bearing surface 38 in contact with a lug 39, fast with the rear of the torch 9 and provided with a spherical end capable of sliding on the bearing surface 38. Elastic means 40, provided between the mount 25 and the torch 9, make it possible to apply the seal 29 against the spherical bearing surface 30 and the lug 39 against the spherical bearing surface 38. Seals 28 and 29 are for example made of copper or stainless steel.

Owing to the assembly of FIG. 3, a torch 9 may thus be swivelled about centre 31 to give corresponding angle a and/or angle b any desired angle, and these angles may even be varied continuously. Pivoting of a torch 9 about centre 31 may be ensured by any mechanical, pneumatic, electrical, . . . or even manual means (not shown).

What is claimed is:

1. A process for destroying solid waste by pyrolysis, wherein a column of such waste is upwardly traversed at least partially by a stream of hot gas blown in at the base of said column, said stream of hot gas being generated by a plurality of plasma jets distributed over the periphery of said waste column, in the vicinity of the base thereof, wherein the direction of each plasma jet is inclined with respect to the direction of the corresponding radius of the waste column.

2. The process of claim 1 wherein the direction of each plasma jet is downwardly inclined with respect to the horizontal, in the direction of the base of said column.

3. The process of claim 2 wherein the direction of each plasma jet with respect to the horizontal is adjustable.

4. The process of claim 1 wherein the direction of each plasma jet with respect to said radius is adjustable.

5. A device for destroying solid waste by pyrolysis, comprising a vertical wall in which is guided a column of such waste, means for blowing a jet of hot gas disposed in the lower part of said wall and means for evacuating the hot gases disposed in the top part of said wall, said gas jet blowing means being constituted by a plurality of plasma generators distributed over the periphery of said lower part of said wall, wherein the direction of each plasma jet is inclined with respect to the direction of the corresponding radius of the waste column.

6. The device of claim 5 wherein said plasma generators are adjustable in orientation about a horizontal axis.

7. The device of claim 5 wherein said plasma generators are adjustable in orientation about a vertical axis.

8. The device of claim 5 wherein said plasma generators are adjustable in orientation individually.

9. The device of claim 5 comprising an orifice for pouring the molten slag provided in the bottom of said device, wherein at least one of said plasma generators lies at least substantially plumb with said pouring orifice.

10. The device of claim 5 wherein said plasma generators are mounted on said wall via ball joint couplings.

11. The device of claim 10 wherein the elements of each of said ball joint couplings are pressed elastically against one another.

* * * * *